US008596103B2

(12) United States Patent
Weiershausen

(10) Patent No.: US 8,596,103 B2
(45) Date of Patent: Dec. 3, 2013

(54) PERMUTATION LOCK

(75) Inventor: Bernd Weiershausen, Rehe (DE)

(73) Assignee: ABUS August Bremicker Soehne KG, Wetter-Volmarstein (DE)

( * ) Notice: Subject to any disclaimer, the term of this patent is extended or adjusted under 35 U.S.C. 154(b) by 183 days.

(21) Appl. No.: 13/071,782

(22) Filed: Mar. 25, 2011

(65) Prior Publication Data

US 2011/0239715 A1 Oct. 6, 2011

(30) Foreign Application Priority Data

Mar. 30, 2010 (DE) ..... 10 2010 013 400

(51) Int. Cl.
*E05B 37/02* (2006.01)

(52) U.S. Cl.
USPC ..... 70/312; 70/315; 70/324

(58) Field of Classification Search
USPC ..... 70/312, 315–318, 324
See application file for complete search history.

(56) References Cited

U.S. PATENT DOCUMENTS

| | | | | | |
|---|---|---|---|---|---|
| 4,343,165 | A | * | 8/1982 | Bako | 70/312 |
| 4,354,365 | A | * | 10/1982 | Mayer et al. | 70/30 |
| 4,354,366 | A | * | 10/1982 | Bako | 70/312 |
| 4,487,043 | A | * | 12/1984 | Milles | 70/312 |
| 4,520,641 | A | * | 6/1985 | Bako | 70/312 |
| 4,532,784 | A | * | 8/1985 | Yeh | 70/312 |
| 4,615,191 | A | * | 10/1986 | Grandy | 70/26 |
| 4,671,088 | A | * | 6/1987 | Jeang | 70/312 |
| 4,831,860 | A | * | 5/1989 | Sheiman et al. | 70/312 |
| 5,027,623 | A | * | 7/1991 | Ling | 70/26 |
| 5,063,761 | A | * | 11/1991 | Ling | 70/25 |
| 5,109,684 | A | * | 5/1992 | Grandy, Sr. | 70/25 |
| 5,636,539 | A | * | 6/1997 | Tsai | 70/315 |
| 5,924,313 | A | * | 7/1999 | Kuo | 70/26 |
| 5,934,120 | A | * | 8/1999 | Kuo | 70/312 |
| 6,058,744 | A | * | 5/2000 | Ling | 70/28 |
| 6,209,368 | B1 | * | 4/2001 | Lee | 70/312 |
| 6,422,051 | B1 | * | 7/2002 | Kuo | 70/312 |
| 6,449,992 | B1 | * | 9/2002 | Yu et al. | 70/58 |
| 6,523,373 | B1 | * | 2/2003 | Su | 70/58 |

(Continued)

FOREIGN PATENT DOCUMENTS

| | | |
|---|---|---|
| DE | 86 17 170 U1 | 8/1986 |
| DE | DD 269 415 A1 | 6/1989 |

(Continued)

OTHER PUBLICATIONS

Translation of German Search Report dated Nov. 22, 2010 relating to DE 10 2010 013 400.7.

*Primary Examiner* — Suzanne Barrett
(74) *Attorney, Agent, or Firm* — Gifford, Krass, Sprinkle, Anderson & Citkowski, P.C.

(57) ABSTRACT

A permutation lock includes a plurality of adjustment rings which are rotatable about a common axis to set a secret code and includes a locking mechanism which has a blocking element. The blocking element can be displaced in the axial direction with respect to the axis of rotation of the adjustment rings from a blocking position into a release position. The adjustment rings are rotationally operationally coupled to axially movable driver elements. The driver elements have axial elevated portions, wherein the driver elements cooperate via the elevated portions in the axial direction such that the blocking element is only displaced axially in the release position by means of the driver elements in that the secret code is set at the adjustment rings.

20 Claims, 11 Drawing Sheets

(56) References Cited

U.S. PATENT DOCUMENTS

Figure 1:
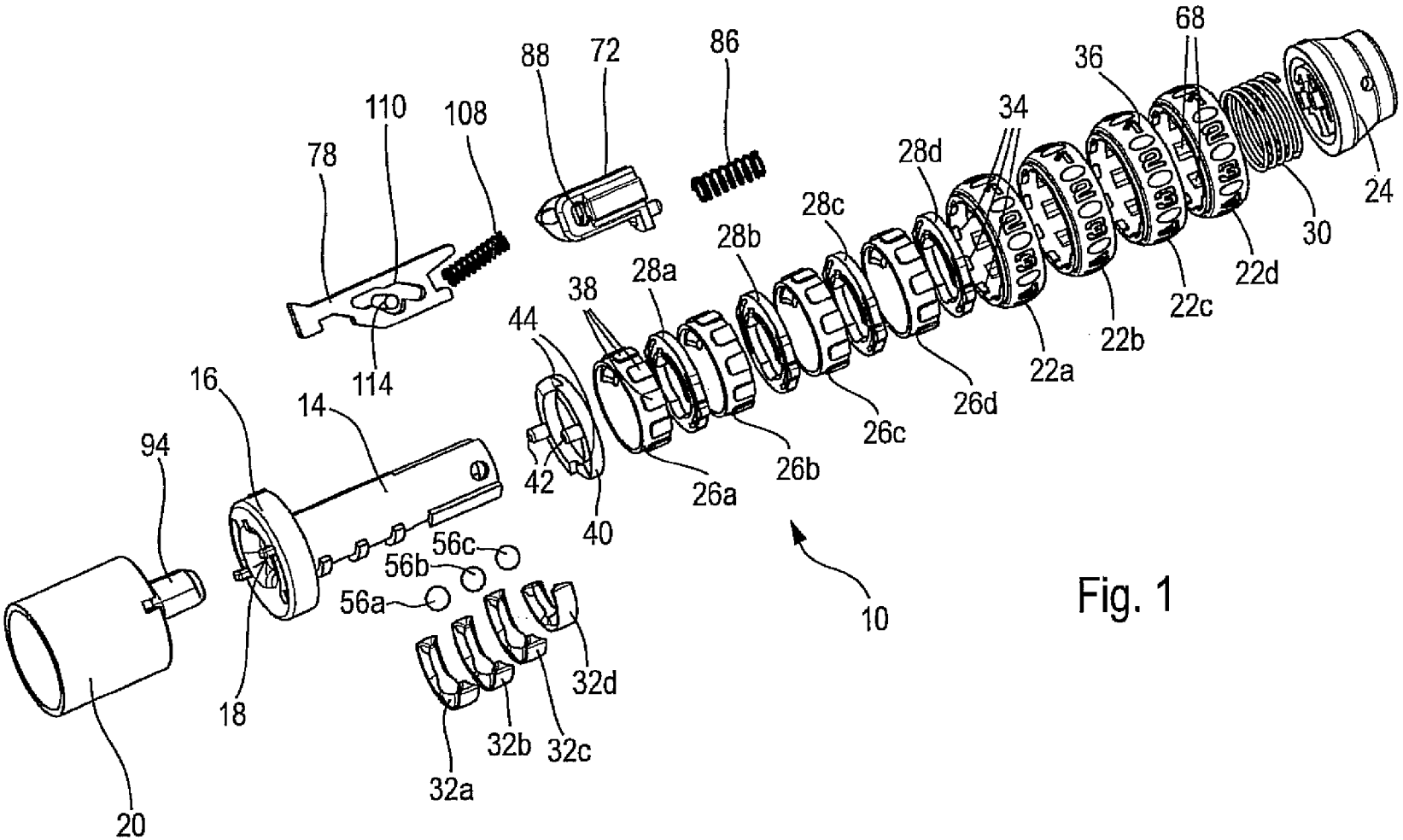

| | | | | |
|---|---|---|---|---|
| 6,672,117 | B2 * | 1/2004 | Yu | 70/58 |
| 6,711,922 | B1 * | 3/2004 | Tsai | 70/312 |
| 6,799,445 | B1 * | 10/2004 | Tsai | 70/30 |
| 6,799,446 | B1 * | 10/2004 | Tsai | 70/30 |
| 6,845,643 | B2 * | 1/2005 | Tsai | 70/312 |
| 6,973,809 | B2 * | 12/2005 | Chang | 70/58 |
| 7,337,637 | B2 * | 3/2008 | Kan et al. | 70/30 |
| 7,458,239 | B1 * | 12/2008 | Ma | 70/21 |
| 7,536,883 | B1 * | 5/2009 | Liu | 70/25 |
| 7,614,266 | B2 * | 11/2009 | White et al. | 70/58 |
| 7,698,914 | B2 * | 4/2010 | Ma | 70/28 |
| 7,805,969 | B2 * | 10/2010 | Poppe et al. | 70/432 |
| 8,020,415 | B2 * | 9/2011 | Corbin et al. | 70/63 |
| 8,087,275 | B2 * | 1/2012 | Poppe et al. | 70/284 |
| 8,297,087 | B1 * | 10/2012 | Lin | 70/26 |
| 2008/0060399 | A1 * | 3/2008 | Lee | 70/312 |

FOREIGN PATENT DOCUMENTS

| | | | |
|---|---|---|---|
| DE | 103 09 224 | A1 | 9/2004 |
| DE | 20 2006 020 233 | U1 | 3/2008 |
| DE | 43 30 478 | C1 | 2/2011 |
| EP | 1 688 567 | A2 | 6/2006 |

* cited by examiner

PERMUTATION LOCK

CROSS-REFERENCE TO RELATED APPLICATIONS

This application claims priority of German Patent Application No. 10 2010 013 400.7 filed Mar. 30, 2010.

The present invention relates to a permutation lock having a plurality of adjustment rings which are rotatable about a common axis to set a secret code and having a locking mechanism which has a blocking element, wherein the blocking element can be displaced in the axial direction with respect to the axis of rotation of the adjustment rings from a blocking position into a release position, wherein the adjustment rings are rotationally operatively coupled with axially movable driver elements.

Such a permutation lock is described, for example, in DE 43 30 478 C1. It has a blocking element provided with a plurality of radially projecting lock bits in the form of a pretensioned latch and a plurality of tumbler rings coupled to the adjustment rings. With a set secret code, the lock bits can be pushed through correspondingly adapted throughhole openings in the tumbler rings. The blocking of the blocking element takes place by rotating the tumbler rings.

With such a permutation lock there is the problem that, as a consequence of the axial movement play between the blocking element and the tumbler rings and as a consequence of the production tolerances, the respective release positions of the tumbler rings can be felt after one another in an unauthorized manner, for which purpose the blocking element is acted on in the axial direction and the tumbler rings are simultaneously rotated after one another, with the throughhole openings in the tumbler rings being able to be felt via the lock bits.

It is therefore proposed in DE 43 30 478 C1 to provide additional noses at the blocking element which are positioned before the locking bits in the axial direction and which block the respective tumbler ring in the direction of rotation when the blocking element is brought into a feeling position. However, there are high demands on the production tolerances with such a permutation lock, whereby the manufacture is undesirably expensive.

A permutation lock is set forth in DE 86 17 170 U1 in which a plurality of recesses are provided at the tumbler rings and are arranged distributed over the periphery and are profiled in accordance with the lock bit throughhole openings to make a feeling of the lock bit through hole openings more difficult. On the above-described manipulation, the recesses are thereby also felt which in this respect product the same feeling as on the feeling of the lock bit throughhole openings and thus make the unauthorized opening substantially more difficult. Ultimately, however, an unauthorized opening by feeling can also not be completely precluded here.

It is therefore the object of the invention to provide a permutation lock of the initially named kind in which the security against an unauthorized opening is improved.

The object is satisfied by the features of claim 1. and in particular in that the driver elements have axial elevated portions, wherein the driver elements cooperate via the elevated portions in the axial direction such that the blocking element is only axially displaced into the release position by means of the driver elements in that the secret code is set at the adjustment rings.

In the permutation lock in accordance with the invention, a closing part (e.g. a locking pin, a striker, a block, a clasp, etc.) can be fixed or fixable directly or indirectly to the locking mechanism. The named blocking element can therefore directly cooperate with the closing part or the blocking element is coupled to a locking element (e.g. latch) which cooperates with the closing part. In the blocking position of the blocking element, the closing part is fixed to the locking mechanism. The closing part is released for a removal in the release position of the blocking element. The position of the axially displaceable blocking element thus determines the locking state of the locking mechanism. The blocking element and/or the closing part fixable to the locking mechanism, however, do not at all have to have a plurality of separate lock bits which cooperate with the locking mechanism (in particular with a respective tumbler ring), as is usual with known permutation locks.

The axial elevated portions are formed at one or both end faces of the respective driver element facing in the axial direction with respect to a normal plane to the axis of rotation of the adjustment rings. The driver elements therefore have a thickness which varies in the peripheral direction and which is at a maximum in the region of the elevated portions. The angular position of the respective axial elevated portion or the angular position of the peripheral region having the greatest thickness relative to the respective adjustment ring in this respect corresponds to the secret code. All the axial elevated portions are only brought into alignment with one another and with respect to the blocking element and are coupled by mutual action in the axial direction such that the blocking element is axially displaced into the release position by a complete setting of the secret code, that is only by a corresponding rotation of the last adjustment ring. In other words, the blocking element is axially displaced into the release position in that, and indeed only in that, the axial elevated portions of all driver elements are axially brought into alignment with one another and are hereby coupled force-wise in the axial direction by a complete setting of the secret code at the adjustment rings.

The adjustment rings are thereby force-decoupled from the closing part in the blocking position of the blocking element, whereby a feeling of the secret code with a simultaneous axial force application on the closing part is impossible or is at least made substantially more difficult. The axial displacement of the blocking element takes place independently of which adjustment ring is set to its respective secret code last. As soon as the secret code is therefore only not set on one adjustment ring, a force flow acting on the blocking element is interrupted so that the blocking element moves into the blocking position or remains therein.

Whenever an indication of direction is named in connection with the invention, it relates generally to the axis of rotation of the adjustment rings.

It must furthermore still be noted that the aforesaid rotationally operative coupling of the driver elements to the adjustment rings is to be understood as a coupling which is rotationally fixed in at least one operating position of the locking mechanism and which can optionally, but temporarily, be suspended (in particular to change the secret code, as will be explained in the following).

In accordance with an advantageous embodiment of the invention, the driver elements have control ramps extending in the peripheral direction, wherein the driver elements cooperate directly or indirectly via the control ramps (in particular via rolling elements) to displace the blocking element axially. The control ramps in this respect so-to-say represent run-out chamfers which facilitate the alignment of the axial elevated portions of the driver elements on the setting of the secret code.

The control ramps preferably extend substantially in a semicircular manner with respect to the axis of rotation of the adjustment rings. The control ramps can hereby extend over a large peripheral region of the respective driver element. The control ramps can in particular extend over a larger peripheral region than the angular contact spacing of the adjustment rings (angular difference between two adjacent adjustment positions). A "gentle" transition, that is a transition extending over a wide angular region, can thus be effected between the blocking position and the release position, which contributes to an increased security against an unauthorized feeling (so-called picking).

A respective axially displaceable rolling element is preferably provided between adjacent driver elements. The rolling element, for example a ball or a roller, reduces the friction between the driver elements on the adjustment of the adjustment rings so that the operating comfort of the permutation lock is increased and friction-induced wear is reduced.

It is preferred if the permutation lock has a housing at which at least one of the rolling elements is held in a fixed angular position with respect to the axis of rotation of the adjustment rings. It is hereby ensured that the rolling elements are in a position with a set secret code which allows the displacement of the blocking element into the release position. The rolling elements are in particular always in alignment with the blocking element. The fixing of the rolling elements can, for example, take place by elongated part deepened portions provided at the housing which are aligned parallel to the axis of rotation of the adjustment rings. The rolling elements are thereby fixed with respect to the peripheral direction, but have the axial play required for blocking or releasing the blocking element. Alternatively or additionally, the rolling elements can also be rotationally fixedly held at the blocking element.

In accordance with a further advantageous embodiment, the permutation lock has—as already mentioned—a closing part which is lockable directly or indirectly at the locking mechanism by means of the blocking element. The closing part can, for example, be a closing pin, a striker or a block, such as is usual in a permutation lock which can be used as a two-wheeler lock. Furthermore, however, the closing part can also have a latch receiver, for example a pivotable bolt or a clasp of a suitcase lock or a lug of a zip of a piece of baggage to be secured.

The permutation lock preferably has a transmission device to transmit the displacement path of the blocking element into an offset of a locking element which is larger than the displacement of the blocking element. The transmission device can, for example, be formed by a pivot lever to allow an indirect locking of a closing part. In this respect, the blocking element can, for example, engage at the one end of the pivot lever, whereas the other end engages behind or releases a block. The locking element can, however, also be a coupling pin guided by a slotted part-, which will be explained in the following. The displacement path of the blocking element can be selected as relatively short by the provision of a transmission device so that the axial elevated portions of the driver elements can be dimensioned as relatively small, which in turn allows a compact construction of the lock.

Alternatively or additionally, the permutation lock can have a deflection device to deflect the axial displacement direction of the blocking element into a displacement direction differing therefrom of a locking element of the locking mechanism (e.g. latch, bolt). For example, a displacement direction extending obliquely or perpendicular to the axis of rotation of the adjustment rings can be provided for the locking element coupled to the blocking element. The permutation lock can hereby be better adapted to the respective application.

In accordance with a further advantageous embodiment of the invention, the locking mechanism has a locking element coupled to the blocking element for locking a closing part which is adjustable between a locking position and an unlocking position and will be generally called a latch in the following. Such a latch is adjustable in the diagonal direction with respect to the axis of rotation of the adjustment rings, for example. An adjustment from the locking position into the unlocking position of the latch can take place, for example, by a removal movement of the closing part or can be assisted by it. Conversely, the adjustment of the latch from the unlocking position into the locking position can take place by an introduction movement of the closing part.

In accordance with an advantageous further development, the latch, the blocking element and a housing of the permutation lock have a respective slotted part, wherein a common coupling pin is received in the slotted parts which is likewise adjustable from a blocking position into a release position by the displacement of the blocking element from the blocking position into the release position to adjust the latch into the unlocking position or to release it for an adjustment into the unlocking position. The coupling pin is in particular adjustable in the perpendicular or diagonal direction with respect to the axis of rotation of the adjustment rings. This arrangement comprising the slotted parts and the common coupling pin preferably forms the above-named transmission device so that the displacement path of the coupling pin is larger than the displacement path of the blocking element.

The slotted part of the blocking element and the slotted part of the housing preferably extend obliquely to one another such that the coupling pin is adjustable solely by the displacement of the blocking element. The two named slotted parts thus form a compulsory guide for the coupling pin.

It is furthermore preferred if the coupling pin and/or a locking spigot provided at the blocking element cooperate with a blocking section of a slotted part provided in the latch such that the latch is blocked in the locking position in the blocking position of the coupling pin and the latch is adjustable between the locking position and the unlocking position in the release position of the coupling pin. A particularly reliable blocking of the latch takes place by a blocking of the latch both by the coupling pin and by the locking spigot. It is, however, also possible to block the latch solely by the locking spigot so that a coupling pin and the associated slotted parts do not have to be provided. Furthermore, instead of a common slotted part for the locking spigot and for the coupling pin, blocking sections can also be provided at separate slotted parts of the latch.

The slotted part of the blocking element and the slotted part of the housing preferably extend obliquely at an angle to one another which is smaller than 45° and in particular amounts to approximately 30°. The transmission function explained above is hereby realized.

In accordance with an advantageous embodiment, the latch is pretensioned in the direction of the unlocking position and/or the blocking element is pretensioned in the direction of the blocking position. A removal movement of the closing part is assisted by the a pretension of the latch. It is moreover prevented that the latch falls back into its locking position when a closing part is not introduced and thereby prevents an introduction of the closing part into the lock. It is ensured by the pretensioning of the blocking element that the blocking element is independently displaced into the blocking position as soon as the secret code is no longer set.

It is preferred if the driver element is rotationally fixedly, but axially movably, coupled to a respective guide ring, with the guide rings being rotatable about the axis of rotation of the adjustment rings. The guide rings thus serve for the driving of the respective driver element in the direction of rotation and are in turn rotationally operatively coupled to a respective adjustment ring.

The latch is preferably additionally blocked in its locking position by the guide rings as long as the secret code is not set at the adjustment rings. The guide rings here act in a similar mariner to tumbler rings in generic permutation locks and prevent, additionally to the blocking element or the coupling pin, that the latch can be displaced into its unlocking position in an unauthorized manner. Even on a violent destruction of the blocking element and/or of the coupling pin, an unauthorized opening of the lock would thus not be possible with a secret code not set. It is preferred in this respect if the latch is also aligned in parallel with the axis of rotation of the adjustment rings during the adjustment movement in order to be able to cooperate with all guide rings at the same time.

In accordance with another advantageous embodiment, the guide rings are blocked in the direction of rotation when the secret code is set at the adjustment rings and the latch is displaced into the unlocking position. In this respect, the latch in its unlocking position preferably engages into cut-outs provided at the guide rings. It is thereby avoided, on the one hand, that, when the closing part is removed, the guide rings are inadvertently rotated by means of the adjustment rings, which would prevent a reintroduction of the closing part into the lock. On the other hand, the blocking of the guide rings prevents that they rotate unintentionally on a change of the secret code explained in more detail in the following.

The adjustment rings and the guide rings are preferably rotationally fixedly coupled to one another in an operating position of the locking mechanism and the adjustment rings and the guide rings are rotatable relative to one another in a release position of the locking mechanism to enable a change of the secret code. To change the secret code, the guide rings and the adjustment rings can therefore temporarily be decoupled from one another so that the adjustment rings can be rotated with respect to the guide rings and thus also with respect to the axial elevated portions of the driver elements to set a new secret code.

The permutation lock preferably has rotationally fixedly held latch rings which have at least one resilient latch section which can be latched to latch recesses of the adjustment rings. A latching of the adjustment rollers is hereby achieved both in the operating position and in the above-explained release position of the locking mechanism in a simple and inexpensive manner.

It is furthermore preferred if the respective driver element is configured as a ring or as a ring segment (in particular semicircular, wherein at least one end face of the driver element has a control ramp extending in the peripheral direction.

Further preferred embodiments of the invention result from the description, from the drawings and from the dependent claims.

Figure 2:
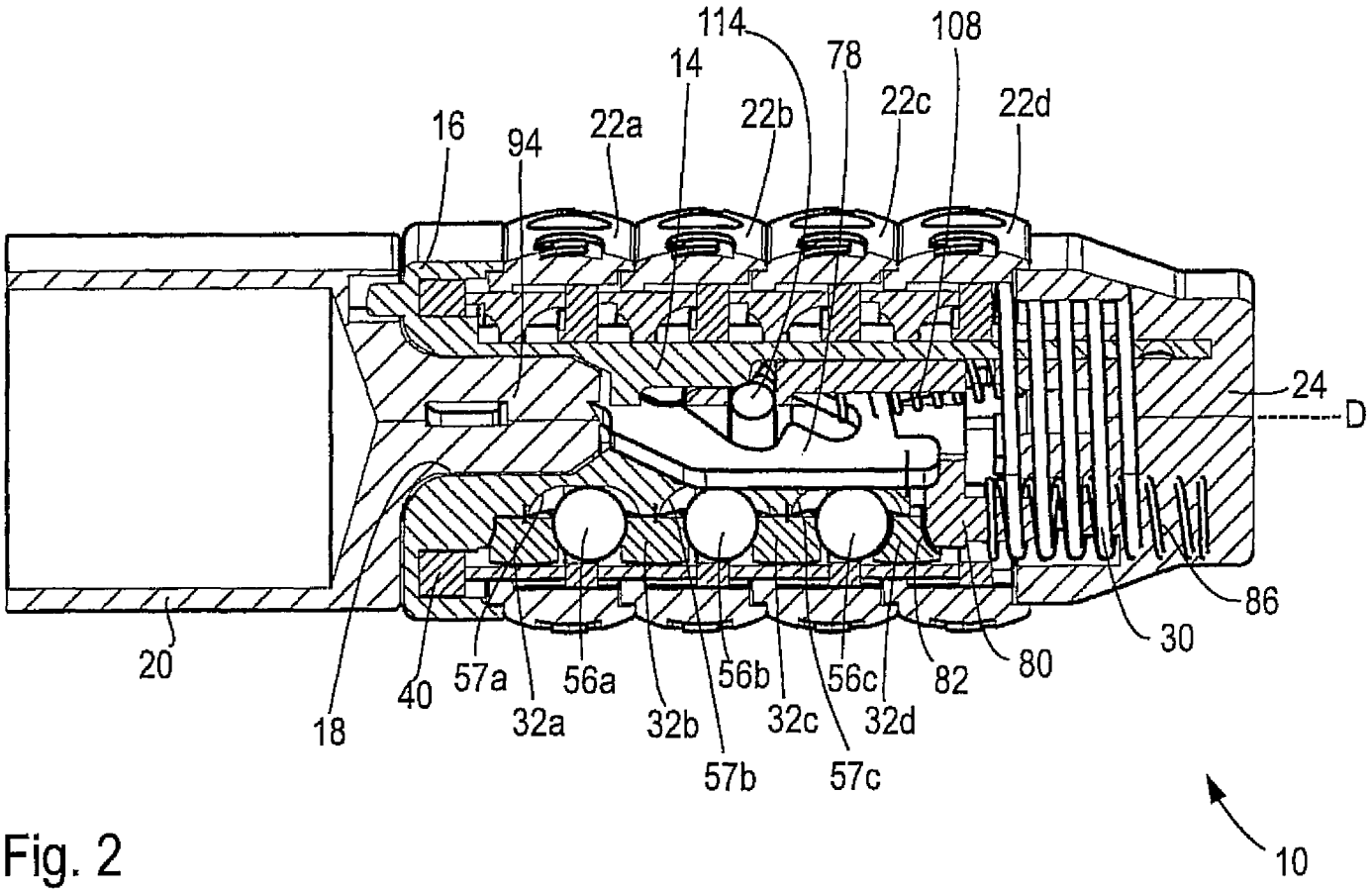
Figure 3:
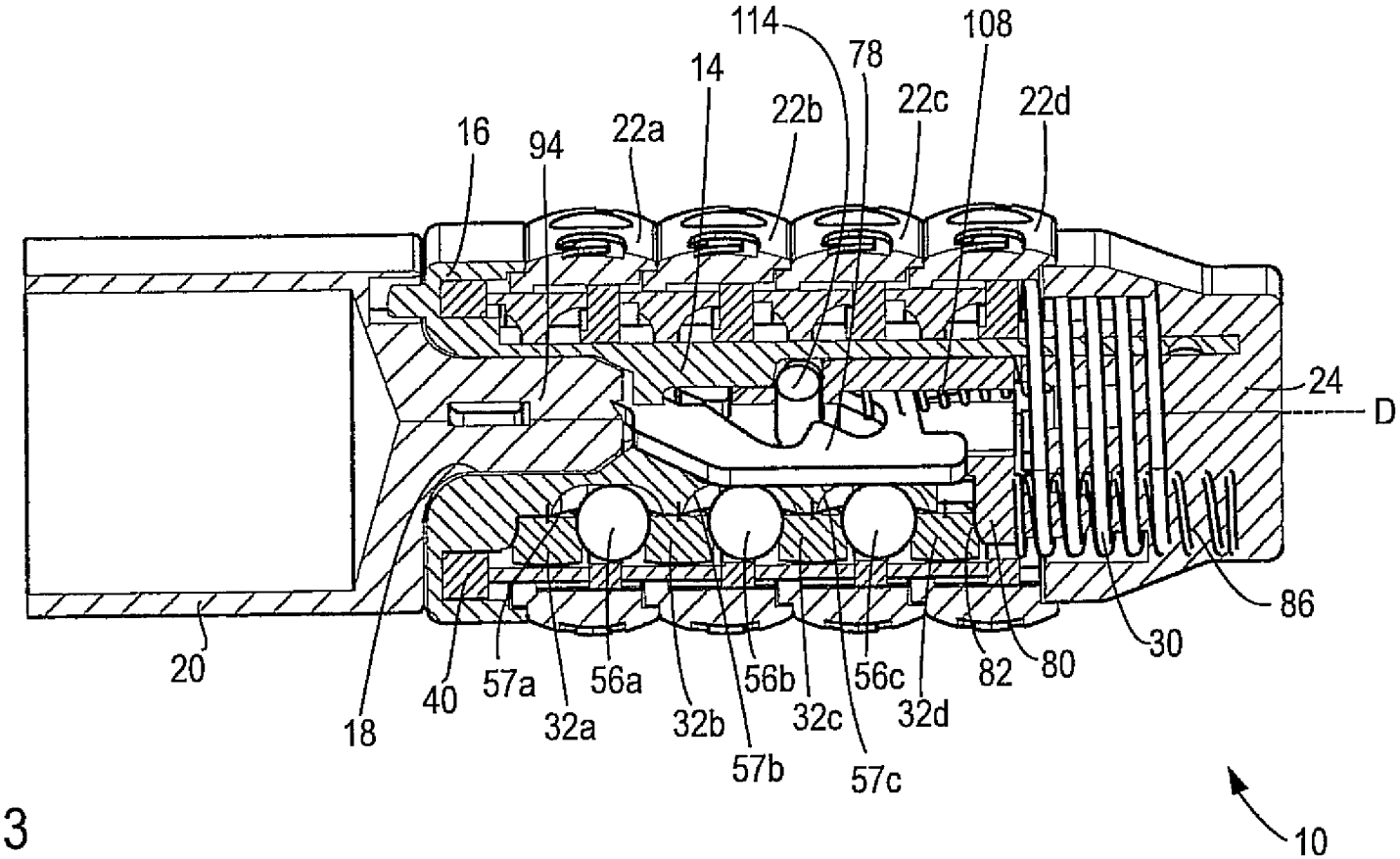
Figure 4:
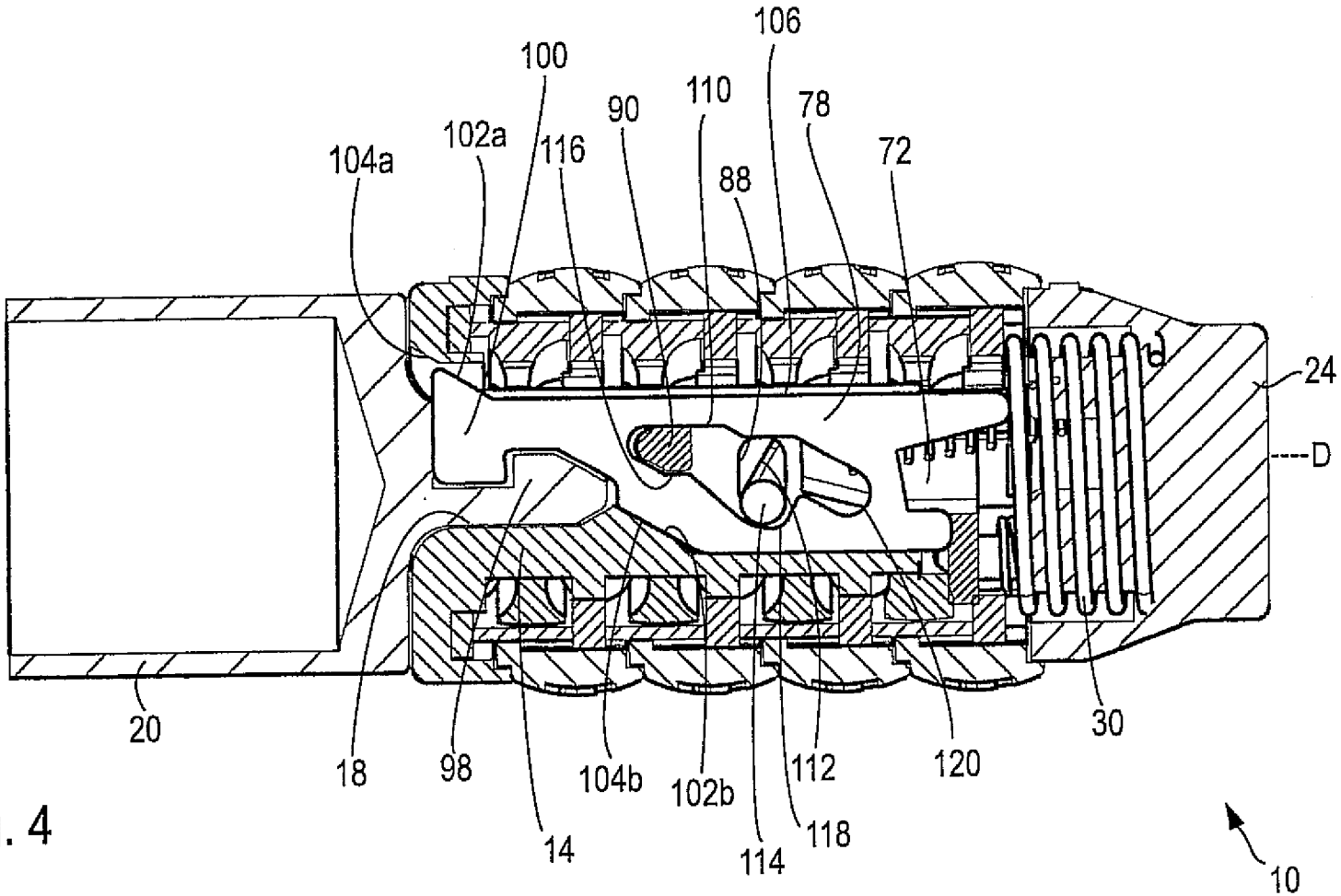
Figure 5:
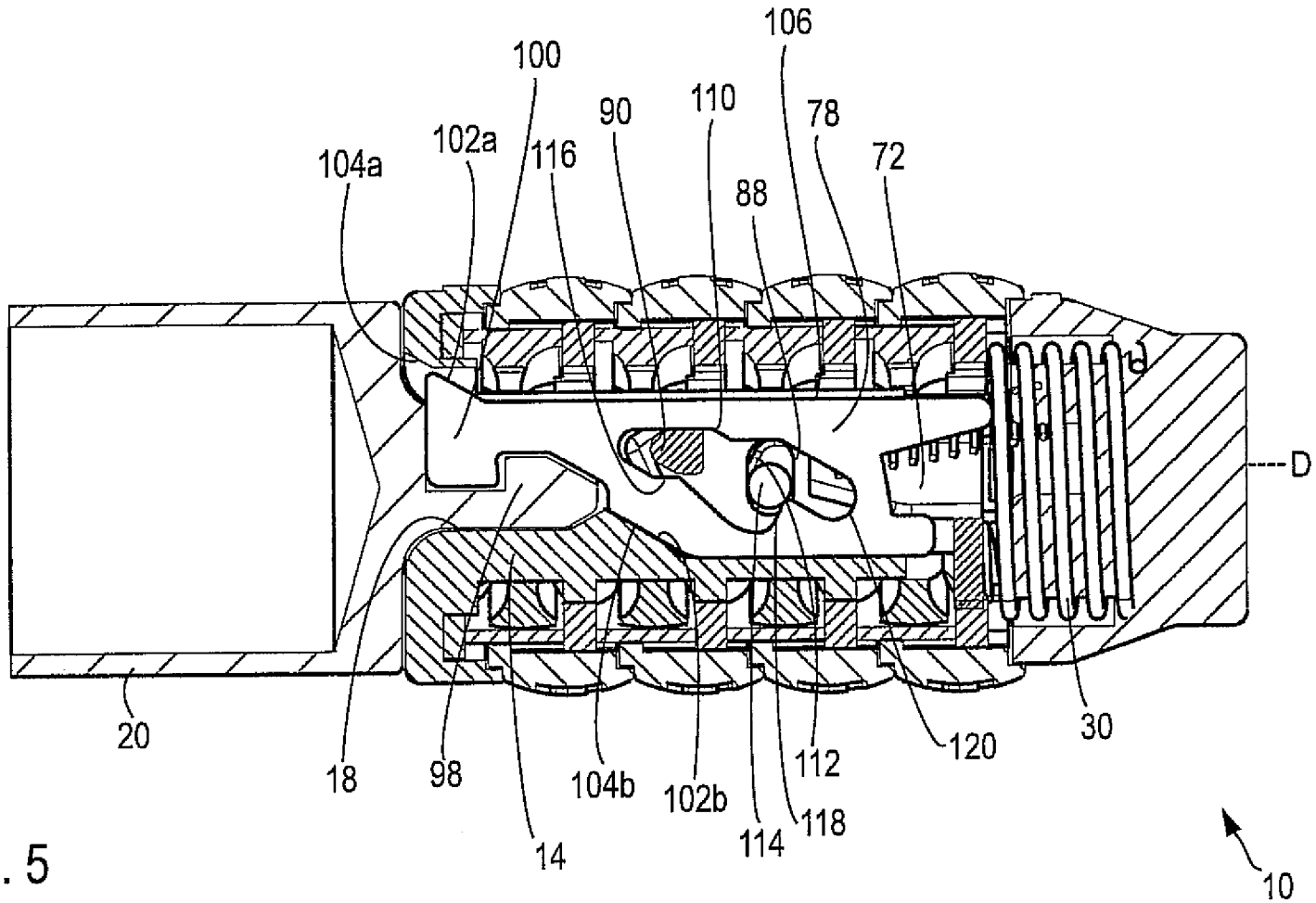
Figure 6:
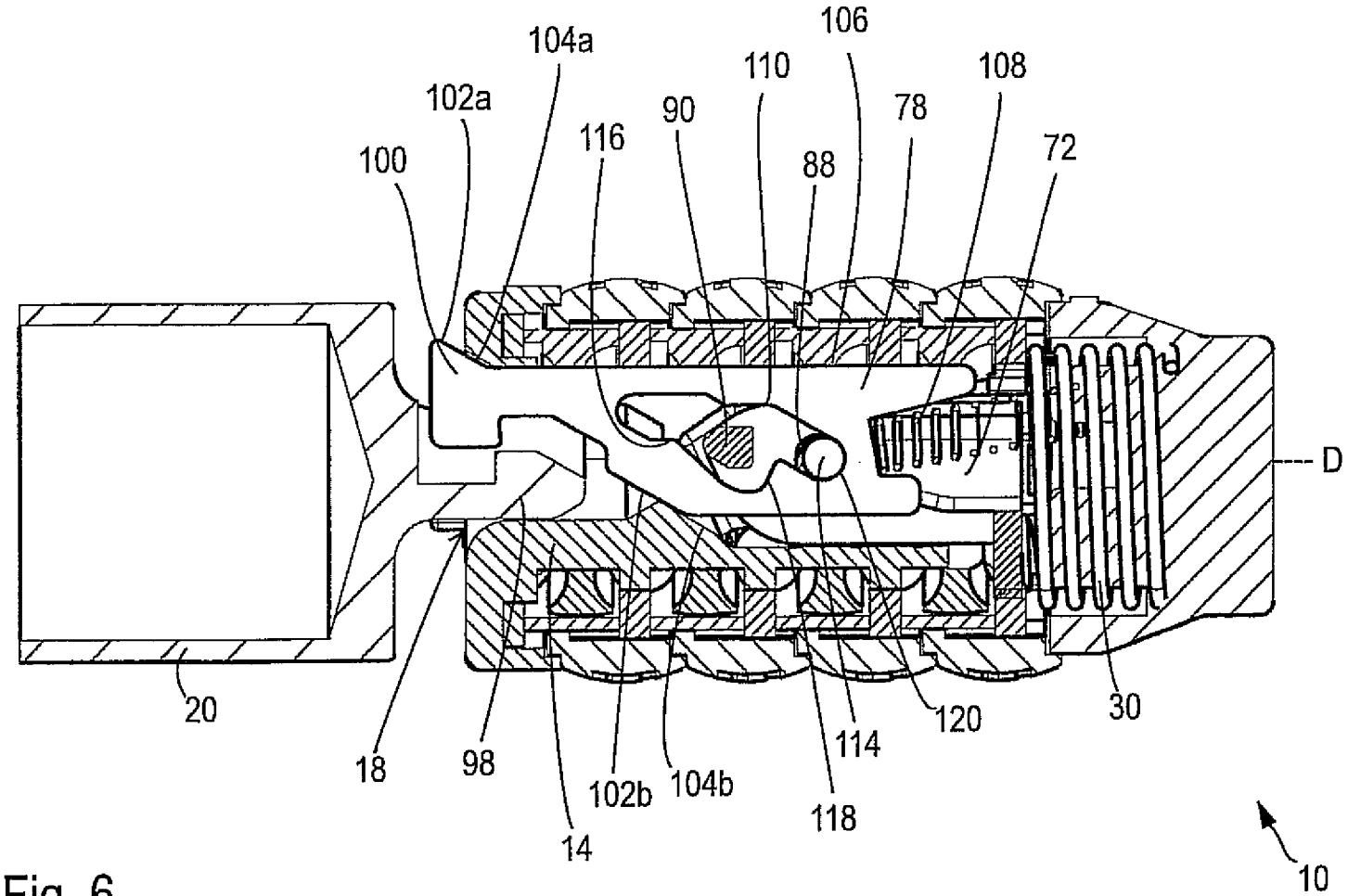
Figure 7:
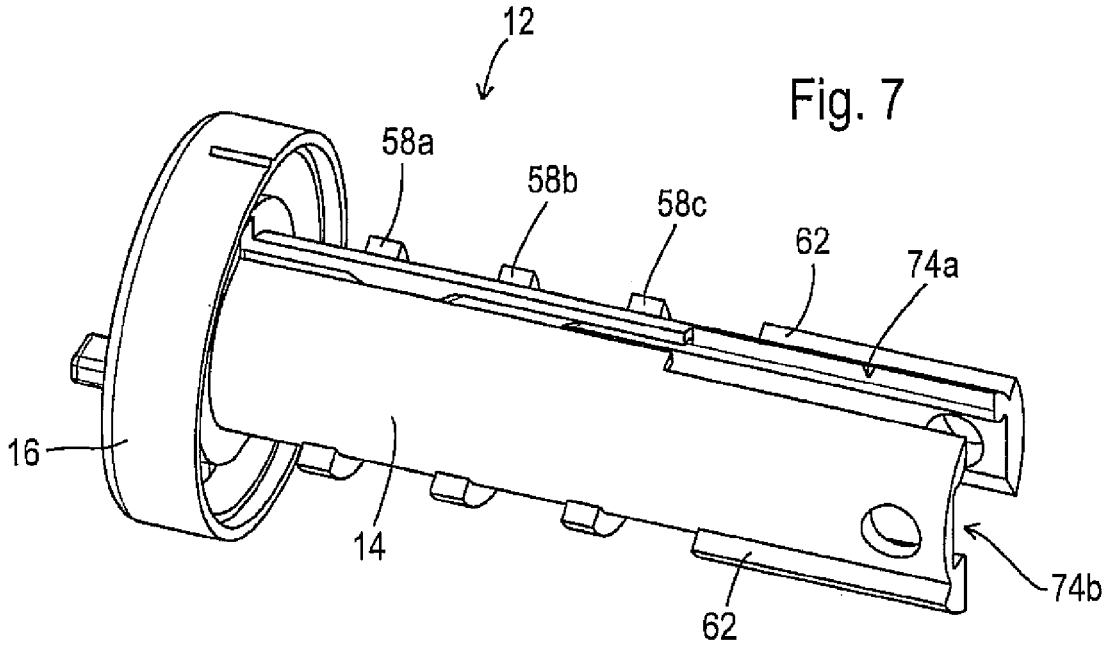
Figure 8:
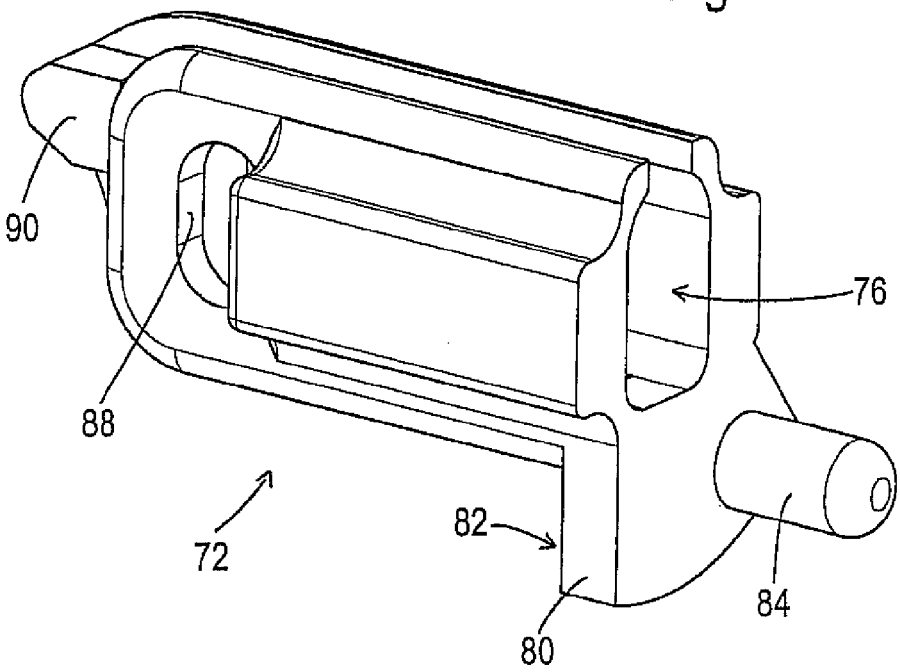
Figure 9:
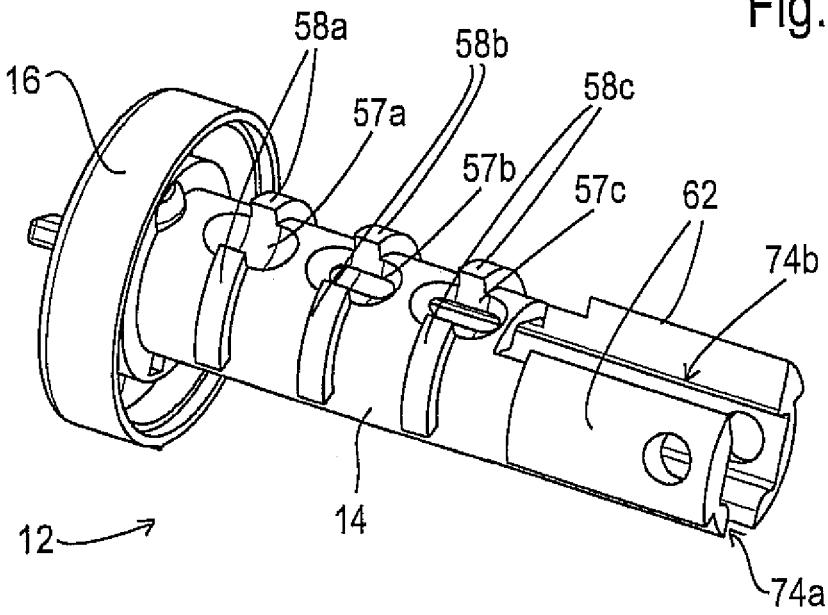
Figure 10:
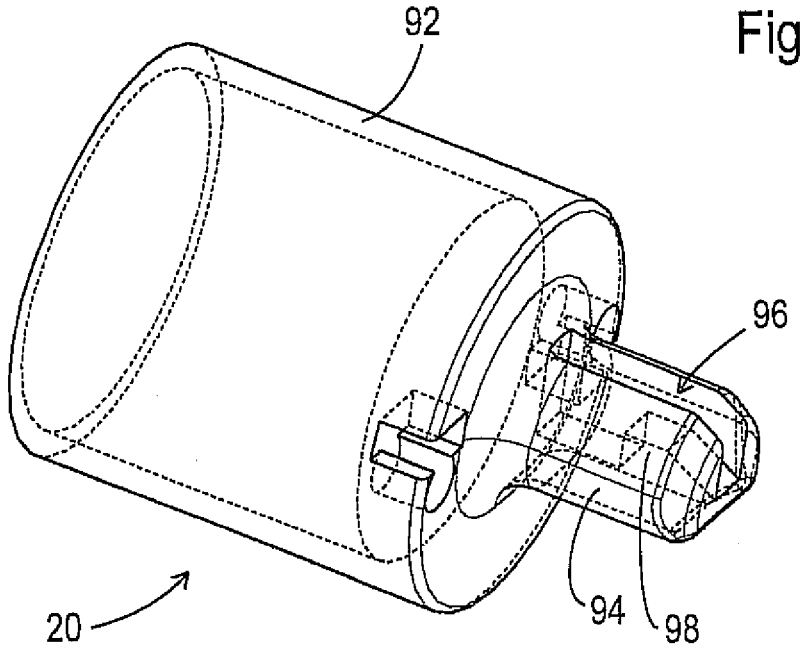
Figure 11:
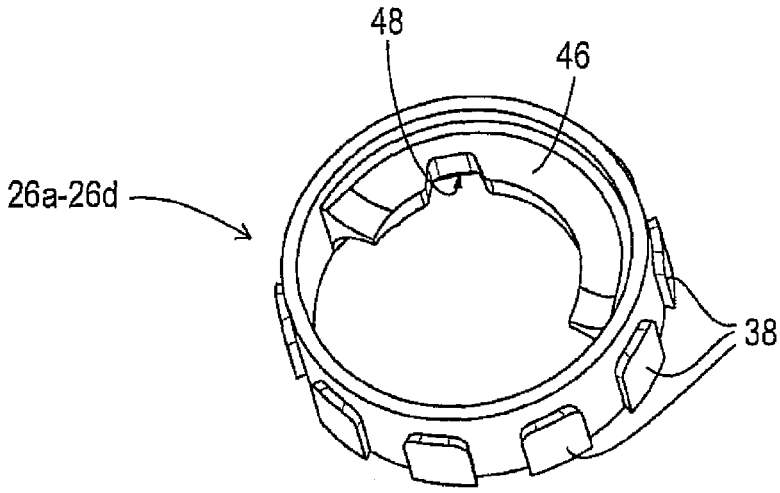
Figure 12:
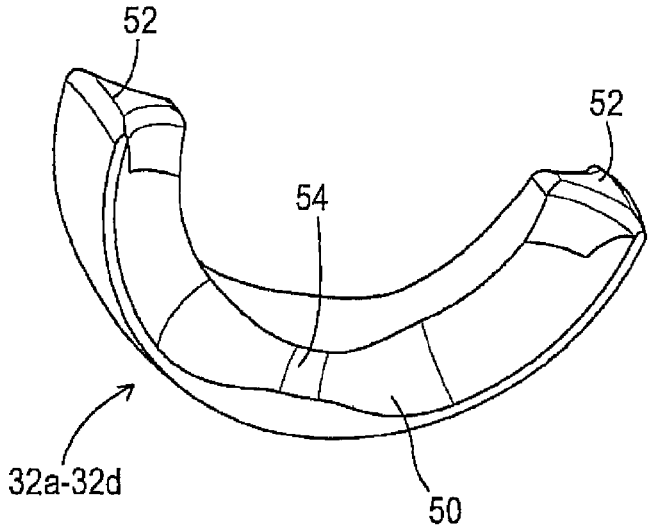
Figure 13:
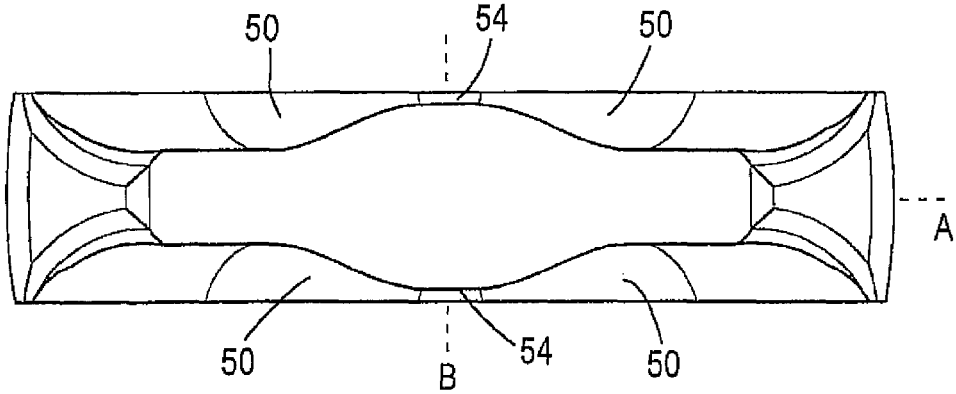
Figure 14:
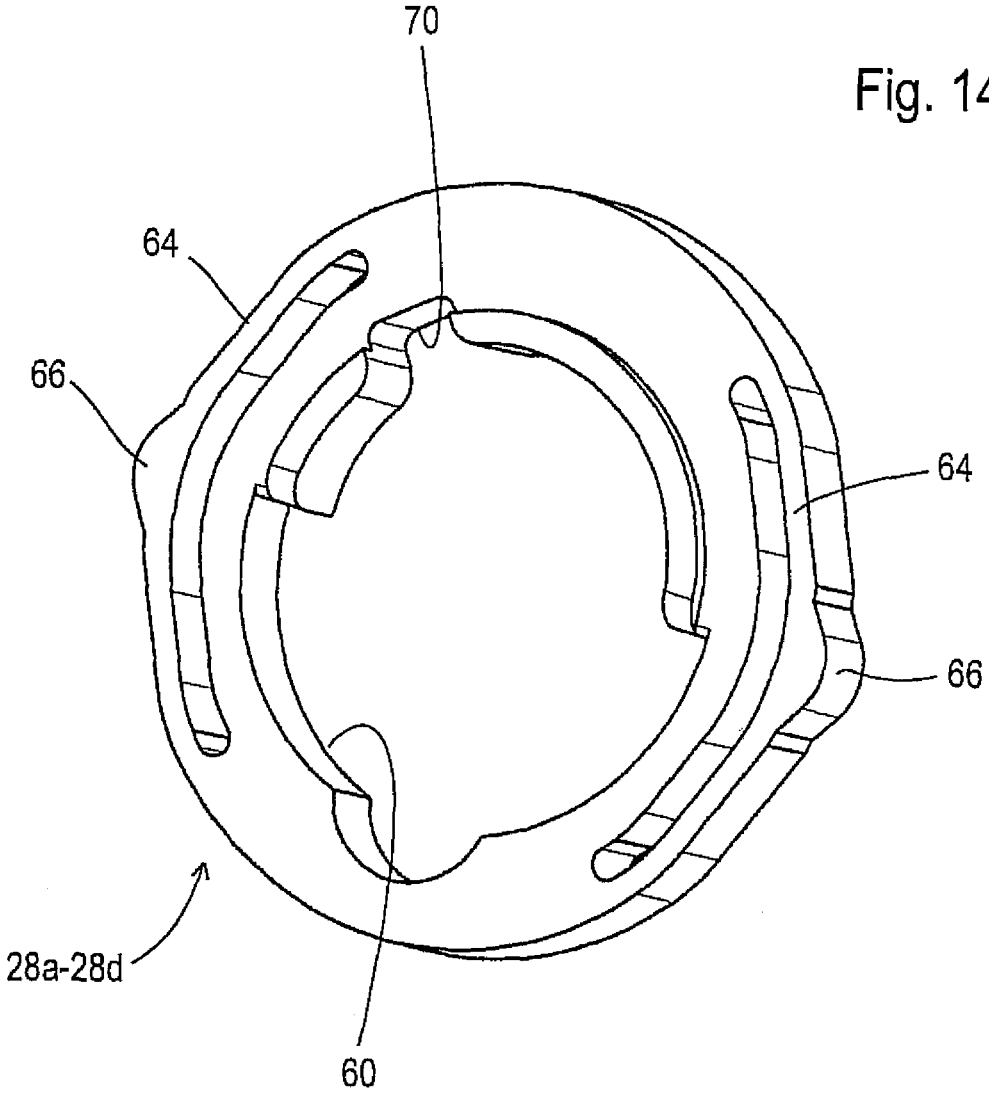
Figure 15:
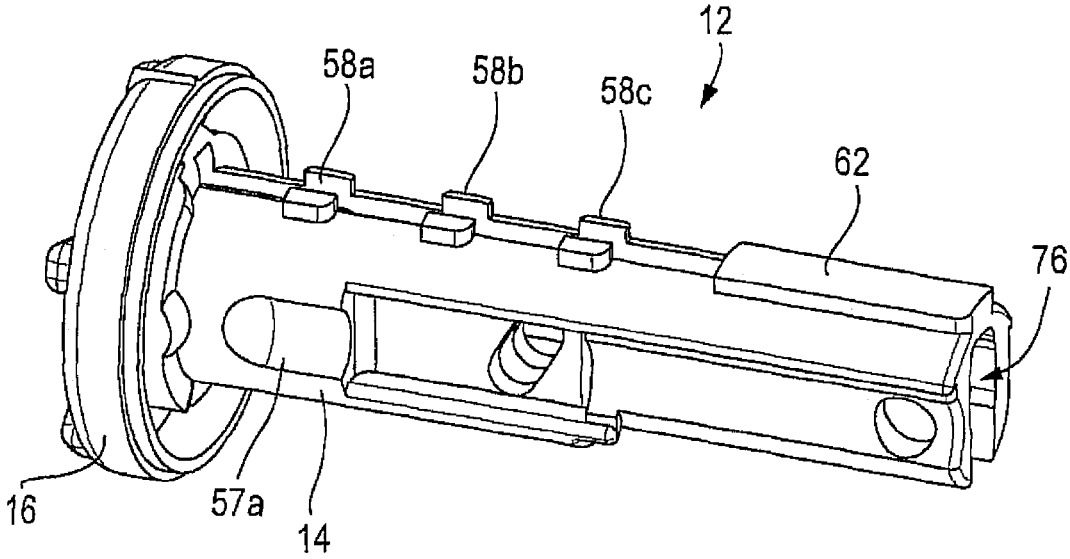

The invention will be described in the following with reference to an embodiment and to the drawings. There are shown:

FIG. 1 a permutation lock in accordance with the invention in an exploded representation;

FIGS. 2 and 3 longitudinal sections of the lock of FIG. 1 in different operating states;

FIGS. 4 to 6 longitudinal sections of the lock of FIG. 1 in different operating states, wherein the sectional plane is inclined about a longitudinal axis of the lock with respect to the sectional plane of FIGS. 2 and 3;

FIG. 7 a perspective view of a housing of the lock of FIG. 1;

FIG. 8 a perspective view of a blocking element of the lock of FIG. 1;

FIG. 9 a perspective view of the housing of FIG. 7 from a different angle of view;

FIG. 10 a perspective view of a locking bolt of the lock of FIG. 1 in a semi-transparent representation;

FIG. 11 a perspective view of a guide ring of the lock of FIG. 1;

FIG. 12 a perspective view of a driver element of the lock of FIG. 1;

FIG. 13 the driver element of FIG. 12 in a plan view;

FIG. 14 a perspective view of a latch ring of the lock of FIG. 1;

FIG. 15 a perspective view of a housing of an alternative embodiment; and

Figure 16:
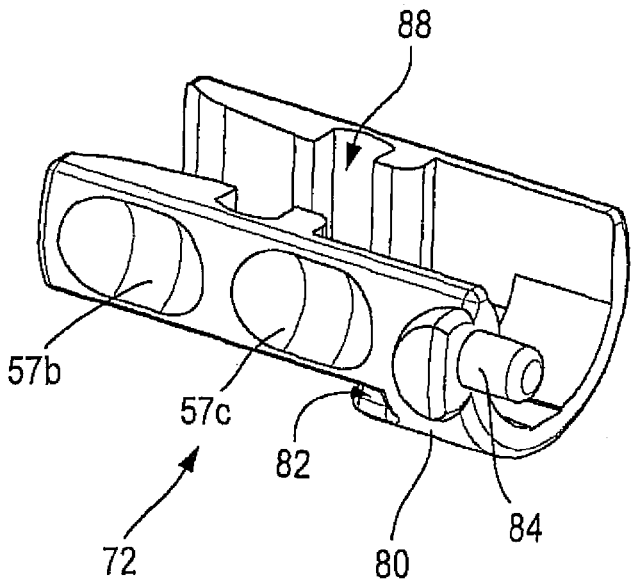

FIG. 16 a perspective view of a blocking element in accordance with the embodiment of FIG. 15.

In accordance with FIGS. 1 to 6, a permutation lock 10 in accordance with the invention includes a housing 12 having a cylindrical section 14 and an end-face flange section 16 which has an axial receiver 18 for a closing pin 20. A cover 24 is unreleasably fastened to the end of the housing 12 disposed opposite the flange section 16. The cover 24 can have means, not shown, for fastening to the one end of a loop (e.g. steel rope) not shown here. In the embodiment shown here, four adjustment rings 22*a* to 22*d* are received rotatably about an axis of rotation D about the cylindrical section 14 between the flange section 16 and the cover 24.

A cylindrical hollow space is defined between the cylindrical section 14 of the housing 12 and the adjustment rings 22*a* to 22*d*, in which cylindrical hollow space guide rings 26*a* to 26*d* and latch rings 28*a* to 23*d* are alternately arranged, wherein a guide ring 26*a* to 26*d* and a latch ring 28*a* to 28*d* are associated with each adjustment ring 22*a* to 22*d*. Whereas the adjustment rings 22*a* to 22*d* are fixed with respect to the housing 12 by the flange section 16 and the cover 24 in the axial direction, the guide rings 26*a* to 26*d* and the latch rings 28*a* to 28*d* are displaceable in the axial direction on the cylindrical section 14.

The adjustment rings 22*a* to 22*d* have a plurality of elevated portions 34 on their inner periphery whose number corresponds to the number of setting markings 36 applied to the outer periphery. An equal number of elevated portions 38 are provided at the outer periphery of the guide rings 26*a* to 26*d* and engage in an operating state of the lock between the elevated portions 34 of the adjustment rings 22*a* to 22*d* so that each adjustment ring 22*a* to 22*d* and the respective guide ring 26*a* to 26*d* are rotationally fixedly coupled.

The guide rings 26*a* to 26*d* and adjustment rings 22*a* to 22*d* can be brought out of engagement to change the secret code. For this purpose a setting ring 40 is provided which is received in the interior of the flange section 16 and which has two actuation pins 42 which project out of the end face of the flange section 16 and allow a rotation of the setting ring 40 with respect to the housing 12 with a removed closing pin 20. The setting ring 40 has two ramps 44 which cooperate with corresponding sections, not shown, of the flange section 16 such that, when the setting ring 40 is rotated from an operating position into a release position, the setting ring 40 is released axially in the direction toward the flange section 16. Driven by the force of a spring 30 concentrically arranged in the cover 24, the setting ring 40 and, at the same time, the guide rings 26*a* to 26*d* and the latch rings 28*a* to 28*d* are adjusted axially in the direction of the flange section 16 so that the elevated portions 34 of the adjustment rings 22*a* to 22*d* and the elevated portions 38 of the guide rings 26*a* to 26*d* temporarily move out of engagement. The adjustment rings 22*a* to 22*d* can thereby be adjusted relative to the guide rings 26*a* to 26*d* so that the secret code can be changed by the user.

As can in particular be easily recognized in FIG. 11, each guide ring 26*a* to 26*d* has at its inner periphery an approximately semicircular inner flange 46 which is provided with a cut-out 48. A respective separate driver element 32*a* to 32*d* which is shown in enlarged from in FIGS. 12 and 13 is received in the interior of the guide rings 26*a* to 26*d*. The driver elements 32*a* to 32*d* are likewise configured in approximately semicircular shape and are adapted to the guide ring 26*a* to 26*d* with respect to their radius of curvature. The guide rings 26*a* to 26*d*, the driver elements 32*a* to 32*d* and the inner flanges 46 are adapted to one another such that the driver elements 32*a* to 32*d* are received axially displaceably, but rotationally fixedly, in the guide rings 26*a* to 26*d*.

The driver elements 32*a* to 32*d* have concave control ramps 50 at their end faces which are in each case symmetrical with respect to an axis A and an axis B (FIG. 13). The control ramps 50 are shaped such that the driver elements 32*a* to 32*d* have a region of maximum thickness or an axial elevated portion 54 at their centers, whereas the thickness reduces toward the end regions 52. It should be mentioned for better understanding that "thickness" is understood here as an effective thickness measured in the axial direction approximately in the region of the inner periphery, but not the thickness in the region of the outer periphery of the driver elements 32*a* to 32*d* which is largely constant in accordance with FIGS. 12 and 13.

As can in particular easily be recognized in FIGS. 2 and 3, a respective ball 56*a* to 56*c* is arranged between adjacent guide rings 26*a* to 26*d*, the balls being held axially displaceable in elongated trough-like deepened portions 57*a* to 57*c* provided at the outer periphery of the cylindrical section 14, but held fixedly with respect to the peripheral direction.

As can easily be recognized in FIG. 9, three cams 58*a* to 58*c* are provided in the region of the deepened portions which each extend approximately over half the periphery of the cylindrical section 14 and engage into a corresponding semicircular recess 60 of the three latch rings 28*a* to 28*c* (FIG. 14) to fix these latch rings 28*a* to 28*c* rotationally fixedly, but axially displaceably, to the cylindrical section 14. To fix the fourth latch ring 28*d*, the cylindrical section 14 has projections 62 which correspond in their cross-section to the cams 58*a* to 58*c*, but have a substantially larger extent in the axial direction and extend up to the end of the cylindrical section 14 received in the cover 24.

The latch rings 28*a* to 28*d* (FIG. 14) have at their outer periphery two mutually oppositely disposed spring sections 64 which are resilient in the radial direction and in whose center a respective radially outwardly projecting latch cam 66 is formed. The latch cams 66 are latchable to latch recesses 68 (FIG. 1) formed at the inner periphery of the adjustment rings 22*a* to 22*d*. It is understood that the number of latch recesses 68 corresponds to the number of setting markings 36.

A blocking element 72 is axially displaceably arranged in the interior of the cylindrical sections 14, with a corresponding cross-section profile of the blocking element 72 and of the inner contour of the cylindrical section 14 as well as slots 74*a* 74*b* provided therein (FIGS. 7 and 9) prevent a rotation of the blocking element 72 with respect to the axis of rotation D.

A slit-shaped receiver 76 for a latch 78 is provided in the interior of the blocking element (FIG. 8), with the receiver 76 being aligned with the slit 74*a* in the assembled state of the lock. The blocking element 72 has a flange-like actuation section 80 which has at its side facing the flange 16 a cam surface 82 which cooperates with the driver element 32*d*. A guide spigot 84 for guiding a spring 86 is arranged at the side of the actuation section 80 opposite the cam surface 82. The spring 86 is held in a corresponding bore of the cover 24 and pretensions the blocking element 72 in the direction toward the flange section 16 and thus into a blocking position.

The blocking element 72 (FIG. 8) furthermore has a slotted part 88 formed as an elongated part hole which extends perpendicular to the axis of rotation D. Finally, a laterally projecting locking spigot 90 which cooperates in a manner still to be explained with the latch 78 is provided at the end disposed opposite the guide spigot 84.

In the following, the design of the closing pin 20 will be described in more detail which serves as a closing part and which can in particular be recognized easily in FIGS. 4 to 6 and 10. The closing pin 20 has a base body 92 which is connectable to the other end of the initially mentioned loop, not shown. At the end side, a cylindrical lock spigot 94 is provided which is received in the latched position in the receiver 18 of the housing 12 and has a longitudinal slit 96. In the longitudinal slit 96, a projection 98 having a front-side run-on chamfer is provided which can be engaged behind by a corresponding locking section 100 of the latch 78 (FIGS. 4 and 5).

The latch 78 (see in particular FIGS. 4 to 6) has oblique guide sections 102*a*, 102*b* which cooperate with oblique guides 104*a*, 104*b* formed in the interior of the cylindrical section 14 and guide the latch 78 so that it can move in translation, i.e. without a superimposed pivot movement, between the locking position (FIGS. 2 to 5) and the unlocking position (FIG. 6) with respect to the axis of rotation D in the diagonal direction. In this respect, a straight edge section 106 formed at the upper side of the latch 78 always extends parallel to the axis of rotation D. The latch 78 furthermore has a slotted part 110 which has a plurality of differently aligned sections whose function will be explained in more detail in the following. A spring 108 active between the latch 78 and the cover 24 pretensions the latch in the direction of the unlocking position shown in FIG. 6.

As can best be recognized in FIG. 4, a slotted part 112 is also provided in the interior of the cylindrical section 14 which is formed by an elongated part hole and which is inclined by an angle of approximately 30° with respect to the slotted part 88 of the blocking element 72. A common coupling pin 114 which is preferably made from hardened steel is received in the slotted parts 88, 110, 112. The cooperation of the slotted parts 88, 110, 112 with the coupling pin 14 will be described in more detail in the following.

The function of the permutation lock 10 will now be described in the following. In the representation in accordance with FIGS. 2 and 4, the latch 78 is in the locking position and the blocking element 72 is in the blocking position. The three adjustment rings 22*a* to 22*c* are located in an adjustment position corresponding to the secret code, whereas the fourth adjustment ring 22*d* is in an adjustment position differing from the secret code. Accordingly, the axial elevated portions 54 of the driver rings 32*a* to 32*c* (FIGS. 12 and 13) are in the region of the balls 56*a* to 56*c*. Since the secret code is still not yet set at the fourth adjustment ring 22*d*, the elevated portion 54 of the driver element 32*d* is located outside a line of alignment defined by the balls 56*a* to 56*c* and the cam surface 82 of the blocking element 72 so that a region of smaller thickness is located between the ball 56*c* and the cam surface 82. In this respect, this region can be both a region of the driver element 32*d* spaced apart from the elevated portion 54, that is the region of the control ramps 50, and a region of the inner flange 465 which is formed at the guide ring 26*d* and whose profile substantially corresponds to the profile of the control ramps in the end regions 52 of the driver element 32*d* so that the inner flange 46 adjoins the driver elements 32*a* to 32*d* in alignment.

If now the corresponding secret code is also set at the fourth adjustment ring 22*d*, the elevated portion 54 of the driver element 32*d* is brought as a consequence into operational connection with the ball 56*c*, on the one hand, and the cam surface 82 of the blocking element 72, on the other hand, as can be seen in FIG. 3. The blocking element 72 thereby moves, for example, by approximately 1.5 mm in the direction of the cover 24 and thus into its release position. If in this operating position any desired adjustment ring 22*a* to 22*d* were now rotated, the force acting between the flange section 16 and the actuation section 80 would be cancelled again so that the blocking element 72 could move back into the blocking position due to the force exerted by the spring 86.

The further operating mechanism of the permutation lock 10 will now be explained with respect to FIGS. 4 to 6. In the operating position shown in FIG. 4, which corresponds to the operating position of FIG. 2, the blocking element 72 is located in its blocking position. The latch 78 is located in its locking position in which the locking section 100 engages behind the projection 98 of the closing pin 20. The latch 78 is locked both by the locking spigot 90 of the blocking element 72, which cooperates with a blocking section 116 of the slotted part 110, and by the coupling pin 114 which is in engagement with a further blocking section 118 of the slotted part 110. The slotted part 88 of the blocking element 72 and the slotted part 112 of the cylindrical section 14 form a kind of compulsory guide, which holds the coupling pin 114 in its position, due to their 30° interleaving.

If now the secret code is set at the adjustment rings 22*a* to 22*d*, the blocking element 72 is displaced from its blocking position (FIG. 4) into the release position (FIG. 5) in the manner previously explained. The coupling pin 114 is thereby displaced obliquely to the top right along the slotted part 112 of the cylindrical section 14 and thus largely releases the blocking section 118 of the latch 78. At the same time, the locking spigot 90 arranged at the blocking element 72 is displaced to the right so that it releases the blocking section 116. This operating position, which corresponds to the operating position of FIG. 3, is shown in FIG. 5.

The latch 78 is still located in its locking position, but is no longer blocked by the blocking element 72. The closing pin 20 can now be removed from the receiver 18. In this process, the guide sections 102*a*, 102*b* of the latch 78 move along the guides 104*a*, 104*b* in a diagonal direction to the top left (FIG. 6). A further guide section 120 of the slotted part 110 which cooperates with the coupling pin 114 prevents a tilting of the latch 78 so that the edge section 106 always extends parallel to the axis of rotation D.

At the start of the removal movement, the coupling pin 114 is displaced further upwardly by the movement of the latch 78 due to the still present minimal engagement with the blocking section 118 so that the coupling pin 114 can no longer block the unlocking movement of the latch 78.

Overall, the displacement path of the coupling pin 114 in the slotted part 112 amounts to approximately 2.6 mm due to the 30° interleaving of the slotted parts 88 and 112 with a displacement path of the blocking element 72 of approximately 1.5 mm.

As can easily be recognized in FIG. 6, the locking section 100 is no longer in engagement with the projection 98 in the unlocking position of the latch 78 so that the closing pin 20 can be completely removed from the receiver 18 for the opening of the permutation lock 10.

The removal movement is assisted by the spring 108 which also holds the latch 78 in the unlocking position shown in FIG. 6 after the removal of the closing pin 20. In this position, the spring 108 therefore prevents an independent falling back of the latch 78 into its locking position, which would make a repeated introduction of the closing pin 20 into the receiver 18 more difficult or would prevent it.

The closing pin 30 is introduced into the receiver 18 for the repeated closing of the permutation lock 10. In this respect, the latch 78 is displaced back in the reverse direction from its unlocking position shown in FIG. 6 into the locking position shown in FIG. 5. An adjustment of the adjustment rings 22*a* to 22*d* effects a displacement of the blocking element 72 from the release position (FIG. 5) into the blocking position (FIG. 4). The locking spigot 90 again moves into engagement with the locking section 116 and the coupling pin 114 is displaced obliquely downwardly to the left along the slotted part 112 so that it comes into engagement with the blocking section 118.

As can be recognized in FIGS. 11 and 14, the guide rings 26*a* to 26*d* and the latch rings 28*a* to 28*d* have at their inner circumferences cut-outs 48 and 70 respectively into which the edge section 106 can dip on the displacement of the latch 78 into the unlocking position. Whereas the cut-outs 70 of the latch rings 28*a* to 28*d* are always aligned with the edge section 106, this is only the case for the cut-outs 48 of the guide rings 26*a* to 26*d* when the secret code is set at the adjustment rings 22*a* to 28*d*. Otherwise, the non-cut out region of the inner flange 46 or the drive element 32*a* to 32*d* prevent a displacement of the latch 78 into the unlocking position. An additional security feature is hereby given so that the latch 78 can also not be removed with a non-set secret code when the other locking mechanism (in particular the blocking element 72) should be set out of operation by a violent manipulation.

FIGS. 15 and 16 show in the views corresponding to FIGS. 7 and 8 a housing 12 and a blocking element 72 respectively in accordance with an alternative embodiment. The blocking element 72 is here made in trough form and engages around the cylindrical section 14 of the housing 12 which is thus configured as particularly stable. In this inverted arrangement, the slit-shaped receiver 76 (for the latch) is accordingly not provided at the blocking element 72, but rather at the housing 12. The deepened portions 57*a* to 57*c* (for the balls) are provided partly at the housing 12 and partly at the blocking element 72. The three cams 58*a* to 58*c* (for the correspondingly shaped recesses of the latch rings) are here configured as shorter and as centrally symmetrical.

The function corresponds in other respects to that in accordance with the embodiment of FIGS. 7 and 8, with no locking spigots 90, however, being provided, i.e. the locking of the latch takes place solely through the coupling pin (not shown in FIGS. 15 and 16).

In a modification of the embodiments described here, it is also possible to provide a radially introducible closing part instead of the axially introducible closing pin. In this case, the blocking element could directly take over the function of the latch or of a locking element in that it engages directly into a corresponding recess of the closing part, for example into a peripheral groove of a block, as is known from the initially named DE 43 30 478 C1.

The invention claimed is:

1. A permutation lock comprising a plurality of adjustment rings (22*a*-22*d*) which are rotatable about a common axis (D) to set a secret code and having a locking mechanism which has a blocking element (72), wherein the blocking element (72) is displaceable with respect to the axis of rotation (D) of the adjustment rings (22*a*-22*d*) in the axial direction from a blocking position and to a release position, wherein the adjustment rings (22*a*-22*d*) are rotationally operationally coupled to axially movable driver elements (32*a*-32*d*), wherein the driver elements (32*a*-32*d*) have axial elevated portions (54), with the driver elements (32*a*-32*d*) axially driving the blocking element (72) into the release position by rotationally bringing the elevated portions (54) of all of the driver elements (32*a*-32*d*) into alignment with one another, wherein the elevated portions (54) of the driver elements (32*a*-32*d*) are configured to be all brought into alignment with one another, only when a complete secret code is set.

2. A permutation lock in accordance with claim 1, wherein a respective axially displaceable rolling element (56*a*-56*c*) is provided between adjacent driver elements (32*a*-32*d*).

3. A permutation lock in accordance with claim 2, wherein the permutation lock (10) has a housing (12) in which at least one of the rolling elements (56*a*-56*c*) is held in a fixed angular position with respect to the axis of rotation (D) of the adjustment rings (22*a*-22*d*).

4. A permutation lock in accordance with claim 1, wherein the driver elements (32*a*-32*d*) have control ramps (50) extending in the peripheral direction, with the driver elements (32*a*-32*d*) cooperating directly or indirectly via the control ramps (50) to displace the blocking element (72) axially.

5. A permutation lock in accordance with claim 4, wherein the control ramps (50) extend substantially in semicircular form with respect to the axis of rotation (D) of the adjustment rings (22*a*-22*d*).

6. A permutation lock in accordance with claim 4, wherein a respective axially displaceable rolling element (56*a*-56*c*) is provided between adjacent driver elements (32*a*-32*d*).

7. A permutation lock in accordance with claim 6, wherein the permutation lock (10) has a housing (12) at which at least one of the rolling elements (56*a*-56*c*) is held in a fixed angular position with respect to the axis of rotation (D) of the adjustment rings (22*a*-22*d*).

8. A permutation lock in accordance with claim 1, wherein the permutation lock (10) has a closing part (20) which can be locked directly or indirectly to the locking mechanism by means of the blocking element (72).

9. A permutation lock in accordance with claim 1, wherein the permutation lock (10) has a transmission device to translate the displacement path of the blocking element (72) into a displacement path of a locking element (78) which is larger than the displacement path of the blocking element (72).

10. A permutation lock in accordance with claim 1, wherein the permutation lock (10) has a deflection device to deflect the axial direction of displacement of the blocking element (72) into a direction of displacement of a locking element (78) differing herefrom.

11. A permutation lock in accordance with claim 1, wherein the locking mechanism has a latch (78) which is coupled to the blocking element (72) for locking a closing part (20) and which can be adjusted between a locking position and an unlocking position.

12. A permutation lock in accordance with claim 11, wherein the latch (78) is pretensioned in the direction of the unlocking position; and/or in that the blocking element (72) is pretensioned in the direction of the blocking position.

13. A permutation lock in accordance with claim 11, wherein the driver elements (32*a*-32*d*) are rotationally fixedly, but axially movably, coupled to a respective guide ring (26*a*-26*d*), with the guide rings (26*a*-26*d*) being rotatable about the axis of rotation (D) of the adjustment rings (22*a*-22*d*), with the latch (78) being additionally blocked in their locking position by the guide rings (26*a*-26*d*) as long as the secret code is not set at the adjustment rings (22*a*-22*d*).

14. A permutation lock in accordance with claim 11, wherein the driver elements (32*a*-32*d*) are rotationally fixedly, but axially movably, coupled to a respective guide ring (26*a*-26*d*), with the guide rings (26*a*-26*d*) being rotatable about the axis of rotation (D) of the adjustment rings (22*a*-22*d*), with the latch (78) blocking the guide rings (26*a*-26*d*) in the rotational direction when the secret code is set at the adjustment rings (22*a*-22*d*) and the latch (78) is displaced into the unlocking position.

15. A permutation lock in accordance with claim 11, wherein the latch (78), the blocking element (72) and a housing (12) of the permutation lock (10) have a respective slotted part (88, 110, 112), with a common coupling pin (114) being received in the slotted parts (88, 110, 112) which can likewise be adjusted from a blocking position into a release position by the displacement of the blocking element (72) from the blocking position into the release position to adjust the latch (78) into the unlocking position or to release it for an adjustment into the unlocking position.

16. A permutation lock in accordance with claim 15, wherein the slotted part (88) of the blocking element (72) and the slotted part (112) of the housing (12) extend obliquely toward one another such that the coupling pin (114) is only adjustable by the displacement of the blocking element (72).

17. A permutation lock in accordance with claim 15, wherein the coupling pin (114) and/or a locking spigot (90) provided at the blocking element (72) cooperate(s) with a blocking section (116, 118) of a slotted part or of the slotted part (110) provided in the latch (78 such that the latch (78) is blocked in the locking position in the blocking position of the coupling pin (114) and the latch (78) is adjustable between the locking position and the unlocking position in the release position of the coupling pin (114).

18. A permutation lock in accordance with claim 15, wherein the slotted part (110) of the blocking element (72) and the slotted part (112) of the housing (12) extend obliquely at an angle to one another which is smaller than 45° and in particular amounts to approximately 30°.

19. A permutation lock in accordance with claim 1, wherein the driver elements (32*a*-32*d*) are rotationally fixedly, but axially movably, coupled to a respective guide ring (26*a*-26*d*), with the guide rings (26*a*-26*d*) being rotatable about the axis of rotation (D) of the adjustment rings (22*a*-22*d*).

20. A permutation lock in accordance with claim 1, wherein the driver elements (32*a*-32*d*) are configured as ring segments whose end faces have control ramps (50) extending in the peripheral direction.

* * * * *